US006287689B1

(12) United States Patent
Elliott et al.

(10) Patent No.: US 6,287,689 B1
(45) Date of Patent: Sep. 11, 2001

(54) LOW SURFACE ENERGY FIBERS

(75) Inventors: John J. Elliott; J. Gregory Hancock, both of Pensacola, FL (US); David B. Horn, Longmeadow, MA (US); W. Keith Fisher, Suffield, CT (US)

(73) Assignee: Solutia Inc., St. Louis, MO (US)

( * ) Notice: Subject to any disclaimer, the term of this patent is extended or adjusted under 35 U.S.C. 154(b) by 0 days.

(21) Appl. No.: 09/473,285

(22) Filed: Dec. 28, 1999

(51) Int. Cl.[7] ..... D01F 8/00

(52) U.S. Cl. ..... 428/370; 428/373; 428/374

(58) Field of Search ..... 428/370, 373, 428/374

(56) References Cited

U.S. PATENT DOCUMENTS

| | | | | |
|---|---|---|---|---|
| 3,118,011 | | 1/1964 | Breen | 264/168 |
| 3,399,259 | | 8/1968 | Brayford | 264/168 |
| 3,491,178 | | 1/1970 | Toyohaski-shi et al. | 264/168 |
| 3,509,013 | | 4/1970 | Oppenlander | 161/173 |
| 3,568,249 | | 3/1971 | Matsui | 18/8 |
| 3,577,308 | | 5/1971 | Van Drunen et al. | 161/176 |
| 3,608,148 | | 9/1971 | Sluijters | 18/85 C |
| 3,657,062 | | 4/1972 | Eshima et al. | 161/173 |
| 3,725,192 | | 4/1973 | Ando et al. | 161/175 |
| 3,726,955 | | 4/1973 | Hughes et al. | 264/171 |
| 3,803,453 | | 4/1974 | Hull | 317/2 R |
| 3,900,678 | | 8/1975 | Aishima et al. | 428/374 |
| 3,930,103 | | 12/1975 | Chimura et al. | 428/361 |
| 3,969,559 | | 7/1976 | Boe | 428/87 |
| 3,993,834 | | 11/1976 | Chimura et al. | 428/373 |
| 4,059,949 | | 11/1977 | Lee | 57/140 |
| 4,069,363 | * | 1/1978 | Segraves et al. | 428/224 |
| 4,075,378 | | 2/1978 | Anton et al. | 428/97 |

(List continued on next page.)

FOREIGN PATENT DOCUMENTS

WO 97/20974 6/1997 (WO) .

OTHER PUBLICATIONS

Abstract of Japanese application No. 56058085 (publication No. 57171720, Oct. 22, 1982) No Translation.
Abstract of Japanese 02 251653A, Oct. 9, 1990 No Translation.
"Surface Energetics of Nylon 66 Fibers", Martha L. Tate, Yashavanth K. Kamath, Sheldon P. Wesson, and Sigrid B. Ruetsch, Art. No. 0072, J. of Colloid and Interface Science, 177, 579–588 (1996).

* cited by examiner

*Primary Examiner*—N. Edwards
(74) *Attorney, Agent, or Firm*—Howrey Simon Arnold & White, LLP

(57) ABSTRACT

The present invention relates to a textile filament with a contact angle greater than or equal to 90 degrees and a tenacity of 2.0 g/den. Such filaments are either water-repellent or resistant to chemicals, and yarns made therefrom readily processible into fabrics. In a detailed embodiment, the filaments are water-repellent and comprise a first longitudinally-extending component comprising at least one polymer selected from nylon, polyester, polypropylene, or other filament-forming polymer, and a second longitudinally-extending component, comprising a halogenated polymer. In a second detailed embodiment, the filaments are chemical-resistant and comprise a first longitudinally-extending component comprising at least one fiber-forming polymer and a second longitudinally-extending component comprising an olefin copolymer. In both embodiments, the second longitudinally-extending component is present on the exterior of the first longitudinally-extending component. The present invention also relates to yarns made from the filaments, and fabrics made from the yarns, as well as methods of making the yarns and the fabric.

8 Claims, 1 Drawing Sheet

U.S. PATENT DOCUMENTS

| | | | | |
|---|---|---|---|---|
| 4,145,473 | | 3/1979 | Samuelson et al. | 428/373 |
| 4,263,691 | | 4/1981 | Pakarnseree | 15/159 A |
| 4,337,155 | | 6/1982 | Sasaki et al. | 210/500.1 |
| 4,384,022 | | 5/1983 | Fowler | 428/296 |
| 4,391,872 | | 7/1983 | Suzuki et al. | 428/224 |
| 4,424,257 | | 1/1984 | Bach | 428/370 |
| 4,657,718 | | 4/1987 | Sicka et al. | 264/146 |
| 4,663,221 | | 5/1987 | Makimura et al. | 428/224 |
| 4,708,080 | * | 11/1987 | Conrad | 114/103 |
| 5,154,934 | | 10/1992 | Okamoto | 425/131.1 |
| 5,226,434 | | 7/1993 | Britton et al. | 132/321 |
| 5,244,614 | | 9/1993 | Hagen | 264/78 |
| 5,256,050 | | 10/1993 | Davies | 425/131.5 |
| 5,260,013 | | 11/1993 | Samuelson | 264/105 |
| 5,277,974 | | 1/1994 | Kubo et al. | 428/373 |
| 5,311,890 | | 5/1994 | Thornton | 132/329 |
| 5,313,909 | | 5/1994 | Tseng et al. | 116/208 |
| 5,314,922 | | 5/1994 | Takai | 521/33 |
| 5,352,518 | | 10/1994 | Muramoto et al. | 428/373 |
| 5,353,820 | | 10/1994 | Subonen et al. | 132/321 |
| 5,372,885 | | 12/1994 | Tabor et al. | 428/373 |
| 5,427,595 | | 6/1995 | Pihl et al. | 51/298 |
| 5,445,884 | | 8/1995 | Hoyt et al. | 428/370 |
| 5,468,555 | | 11/1995 | Lijten et al. | 428/365 |
| 5,505,889 | | 4/1996 | Davies | 264/173.16 |
| 5,520,924 | | 5/1996 | Champman et al. | 424/43 |
| 5,556,589 | | 9/1996 | Sibal | 264/172.12 |
| 5,560,377 | | 10/1996 | Donovan | 132/321 |
| 5,590,420 | | 1/1997 | Gunn | 2/69 |
| 5,605,739 | | 2/1997 | Stokes et al. | 428/198 |
| 5,618,479 | | 4/1997 | Lijten et al. | 264/103 |
| 5,662,978 | | 9/1997 | Brown et al. | 428/57 |
| 5,680,876 | | 10/1997 | Hasham et al. | 132/329 |
| 5,697,390 | | 12/1997 | Garrison et al. | 132/321 |
| 5,711,935 | | 1/1998 | Hills et al. | 424/49 |
| 5,722,106 | | 3/1998 | Masterman et al. | 15/167.1 |
| 5,752,278 | | 5/1998 | Gunn | 2/69 |
| 5,807,490 | | 9/1998 | Davis et al. | 210/739 |
| 5,807,633 | * | 9/1998 | Tamaru et al. | 428/400 |
| 5,829,057 | | 11/1998 | Gunn | 2/69 |
| 5,832,636 | * | 11/1998 | Lyden et al. | 36/59 R |
| 5,837,179 | | 11/1998 | Pihl et al. | 264/172.11 |
| 5,871,836 | * | 2/1999 | Schultink et al. | 428/181 |
| 5,958,806 | * | 9/1999 | Jensen et al. | 442/401 |
| 6,057,414 | * | 5/2000 | Razavi | 527/491 |

LOW SURFACE ENERGY FIBERS

BACKGROUND OF THE INVENTION

1. Field of the Invention

The present invention relates generally to the fields of synthetic filaments and fabrics made therefrom. More particularly, it concerns synthetic filaments that have both low surface energy and high strength.

2. Description of Related Art

Fabrics which are water-repellent (i.e. provide a barrier to moisture) while allowing the passage of water vapor and other gases are desirable for use in apparel, shoes, tents and camping equipment, packaging, medical apparel, and medical supplies. Such fabrics require fibers that have both a low surface energy to repel water and a strength high enough to be processible into a useful fabric. Other desirable fabrics are both water-repellent and do not allow the passage of water vapor and other gases, for use in airtight packaging and medical supplies.

In packaging, protective apparel, and industrial filtration, a need exists for fabrics that are stable to both heat and chemicals. Such fabrics require fibers both low in surface energy and high enough in strength to be processible into a useful fabric, as well as heat and chemical resistance.

One class of water-repellent fabrics are those made by applying a finish to a fabric or its component filaments before or after the weaving or knitting process. The finish is intended to provide the low surface energy needed to repel water. However, such finishes tend to have poor durability and washfastness.

A second class of water-repellent fabrics are those comprising water-repellent materials. An example of this class is a fabric comprising polytetrafluoroethylene (PTFE) sold by W. L. Gore Inc. under the trade name GORE-TEX®. Known uses of PTFE fabrics are limited to lamination of the PTFE fabric to a textile fabric. This suggests that PTFE fabrics, although having low surface energy, do not have high enough strength to be useful fabrics per se.

Therefore, it is desirable to have a textile fabric made of filaments that exhibit low surface energy and strength high enough to be processible into useful fabrics. It is also desirable for such filaments to be produced by high throughput, economical spinning technology. Although filaments with a core/sheath structure wherein the sheath comprises a halogenated polymer are known (Chimura et al., U.S. Pat. Nos. 3,930,103 and 3,993,834), the core of the known filaments comprises primarily methyl methacrylate, and is not useful in forming moisture-resistant fabrics. Although core/sheath filaments wherein the core comprises nylon and the sheath comprises a grafted olefinic polymer are known, such as Tabor et al., U.S. Pat. No. 5,372,885, no such filaments are known to comprise a sheath useful in heat- and chemical-resistant fabrics.

SUMMARY OF THE INVENTION

In one embodiment, the present invention relates to a filament comprising a first longitudinally extending component formed of at least one filament-forming polymer, and a second longitudinally extending component formed of at least one polymer, wherein the second longitudinally extending component is in contact with the surface of the first longitudinally extending component, and wherein the filament has a contact angle greater than or equal to 90 degrees and a tenacity of at least 2.0 g/den. In one embodiment, the first longitudinally extending component forms the core of the filament, and the second longitudinally extending component is in the form of a sheath that surrounds the circumference of the core. In another embodiment, the second longitudinally extending component is in the form of one or more stripes located on the surface of the first longitudinally extending component.

In another embodiment, the present invention also relates to a yarn, wherein the yarns comprise a plurality of filaments as described above. The present invention also relates to a fabric comprising a plurality of said yarns, wherein the spacing between the yarns is sufficiently small to provide a barrier to liquids and sufficiently large to allow the passage of gases, or is sufficiently small to provide a barrier to liquids and to gases.

In a further embodiment, the present invention relates to a method for making a yarn comprising coextruding (1) a first molten stock comprising at least one filament-forming polymer, and (2) a second molten stock comprising at least one polymer, whereby the second molten stock forms a second longitudinally-extending component on the surface of the first molten stock, thereby forming molten filaments, and quenching the molten filaments, a plurality of which are formed into yarn. The method can further comprise drawing the yarn.

In yet another embodiment, the present invention also relates to a method of making a fabric, comprising providing a plurality of yarns, wherein each said yarn comprises a plurality of filaments as described above, and weaving or knitting the plurality of yarns with a spacing between the yarns sufficiently small to provide a barrier to liquids and sufficiently large to allow the passage of gases, to yield the fabric. Alternatively, the spacing is sufficiently small to provide a barrier to liquids and a barrier to gases.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

Figure 1:
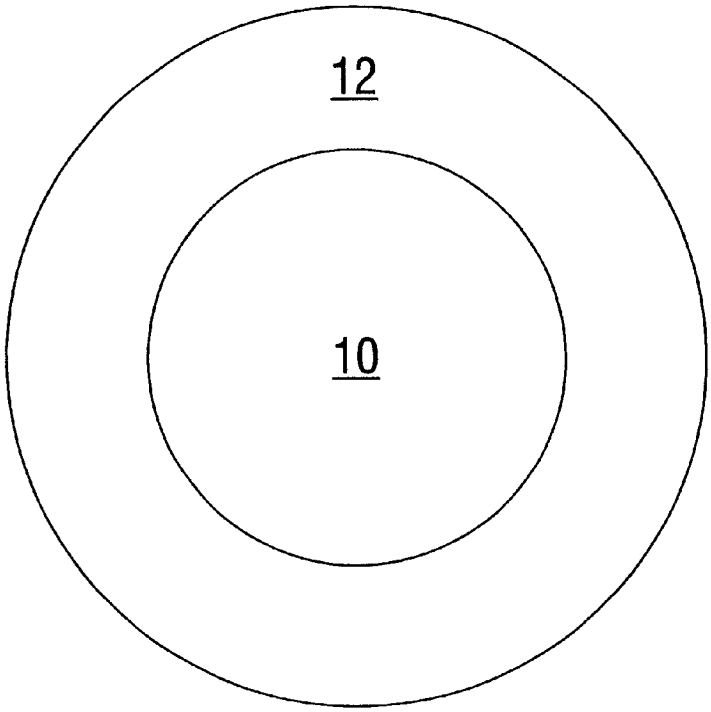
FIG. 1, not to scale, is a cross-section of one embodiment of a filament in which a first longitudinally extending component is in the form of a core 10 and is surrounded by a second longitudinally extending component in the form of a sheath 12.
Figure 2:
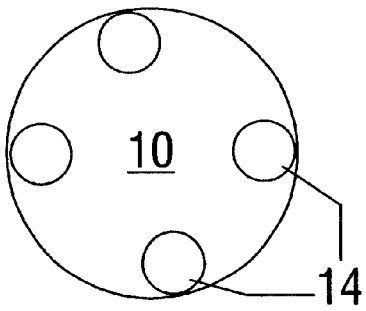
FIG. 2, not to scale, is a cross-section of another embodiment of a filament in which a first longitudinally extending component 10 is surrounded by a second longitudinally extending component in the form of stripes 14. The number of stripes in the figure is illustrative and not to be construed as limiting the scope of the present claims to the particular embodiment shown.

Herein, the terms "filament" and "fiber" may be used interchangeably according to their standard meanings in the art.

In one aspect, the present invention relates to a filament comprising a first longitudinally extending component comprising at least one filament-forming polymer and a second longitudinally extending component comprising at least one polymer, wherein the second longitudinally-extending component covers at least part of the first longitudinallyextending component and the filament has a contact angle greater than or equal to 90 degrees and a tenacity of at least 2.0 g/den. Such a filament may be herein termed a "bicomponent filament." Contact angle, dispersive surface energy, and non-dispersive work of adhesion can be measured by methods known in the art (Tate et al., *J. Colloid and Interface Sci.,* 177, 579–583 (1996)). Typically, filaments with a contact angle greater than or equal to 90 degrees have a non-dispersive work of adhesion in water equal to or less than 26 mN/m. Tenacity can be measured by techniques known to those skilled in the art. Exemplary techniques are described in the Examples below.

In a first class of embodiments of this aspect, the present invention is directed to filaments comprising a first longitudinally extending component comprising at least one polymer selected from nylon, polyester, polypropylene, or other filament-forming polymer, and a second longitudinally extending component present on the surface of the first longitudinally extending component, comprising a halogenated polymer. Such filaments have a low surface energy and a high tenacity. The low surface energy makes the filaments resistant to moisture, and the high tenacity makes the filaments processible into a fabric. Hereinafter, "processible into a fabric" shall mean readily knitted or woven or both to form a fabric useful in textiles or packaging.

A filament of the present invention has a contact angle greater than or equal to 90 degrees and a tenacity of at least 2.0 g/den. This provides for the filament to be both water repellent and processible into a fabric. In one embodiment, the filament has a core/sheath structure in which the sheath surrounds the core. Hereinafter, "surrounding the core" shall mean covering enough of the core so as to give sufficient halogenated polymer on the surface of the fiber to provide a contact angle greater than or equal to 90 degrees. Typically, the sheath will cover about 90% or more of the outer surface of the core, and preferably, the sheath will cover 100% of the outer surface of the core. The core and sheath can be of any sectional profile (e.g. circular, pentalobal, etc.). A typical, but not limiting, profile is a circular core surrounded by a ring of sheath.

In a second embodiment, the filament has a "racing stripe" structure in which the halogenated polymer component is present in the form of longitudinal stripes on the external face of the first longitudinally extending component. The number of longitudinal stripes is selected so as to give sufficient halogenated polymer on the surface of the fiber to provide a contact angle greater than or equal to 90 degrees.

The optimal sectional profile to be used in a filament will depend on the intended application of the filament and will be readily determined by one skilled in the art.

The first longitudinally extending component of the filament comprises at least one polymer selected from nylon, polyester, polypropylene, or other filament-forming polymer. Any polymer known to those skilled in the art to be useful in the production of textile filaments can be used in the present invention. Polymers of nylon, polyester, and polypropylene are known to have sufficiently high tenacity to be useful in the production of textile filaments. Typically, such polymers have poor light transmittance, in distinction to the core polymers disclosed by Chimura et al., cited above. It is desirable for a filament-forming polymer to have crystallization rates and/or elongational viscosity similar to those same properties of the halogenated polymer of the second longitudinallyextending component in order to better share spinning stress.

Filament-forming polymers that can be used in the first longitudinally-extending component include, but are not limited to, nylon 6,6, other nylons, polybutylene terephthalate, other polyesters, and polypropylene. Nylon 6,6 and polyester are preferred. Other filament-forming polymers that may be used in the present invention will be clear to one skilled in the art.

The first longitudinally-extending component of the filament can also include additives such as nucleating agents and colorants, among other additives. Additives can be added to the molten first longitudinally-extending component prior to extrusion of the filament. Nucleating agents may be useful in increasing the crystallization rate of the first longitudinally-extending component to more nearly match that of the second longitudinally-extending component. If it is desired to color the filament by coloring the first longitudinally-extending component, then colorants can be added to the molten first longitudinally-extending component before coextrusion with the second longitudinally-extending component. Typically, colorants in the present invention will be solid pigments dispersed in either a carrier polymer or blended beforehand in the first longitudinally-extending component polymer, wherein the carrier polymer can be selected for compatibility with the first longitudinally-extending component polymer by one skilled in the art. Other additives that can be used in the first longitudinally-extending component are a fluoroalcohol or a halogenated polymer, in order to aid adhesion of the first longitudinally-extending component and the second longitudinally-extending component. Other additives can be used, and their identity and the circumstances making their use desirable will be clear to one skilled in the art.

The concentration of the polymer selected from nylon, polyester, polypropylene, or other filament-forming polymer in the first longitudinally-extending component can be varied depending on the polymer selected for use, the presence of other additives in the first longitudinally-extending component, and the composition of the second longitudinally-extending component. Preferably, the concentration of filament-forming polymer in the first longitudinally-extending component can be from about 80.0 wt % to 100.0 wt %. The remaining 0.0 wt % to about 20.0 wt % can comprise nucleating agents, colorants, halogenated polymers, and other additives as described above. In a preferred embodiment, the first longitudinally-extending component comprises about 95 wt % nylon 6,6 and about 5 wt % nylon 6.

The second longitudinally-extending component of the filament comprises a melt-processible halogenated polymer. A melt-processible halogenated polymer that can be used in the present invention is a 1:1 alternating copolymer of ethylene and chlorotrifluoroethylene (hereinafter "poly (ethylene chlorotrifluoroethylene);" commercially available from Ausimont Inc., trade name HALAR®). All references herein to "halogenated polymers" should be taken to mean "melt-processible halogenated polymers" unless otherwise indicated. All references herein to "HALAR®" should be taken to mean "poly(ethylene chlorotrifluoroethylene)." Halogenated polymers in the second longitudinally-extending component provide low surface energy to the filament.

The second longitudinally-extending component can also include additives such as nucleating agents, colorants, and anti-microbial additives, among others. Nucleating agents and colorants are as described above. Anti-microbial additives, for example zinc oxide, can be added to enhance the useful life of the filaments and fabrics made therefrom in medical applications. Other additives can be used, and their identity and the circumstances making their use desirable will be clear to one skilled in the art. It is desirable that any such additives not lower the contact angle below 90 degrees.

The concentration of the halogenated polymer in the second longitudinally-extending component can be varied depending on the halogenated polymer selected for use, the presence of other additives in the second longitudinally-extending component, and the composition of the first longitudinally-extending component. Preferably, the concentration of halogenated polymer in the second longitudinally-extending component can be from about 80.0 wt % to 100.0 wt %. The remaining 0.0 wt % to about 20.0 wt % can comprise nucleating agents, colorants, antimicrobial additives, and other additives as described above.

It is to be noted that the first longitudinally extending component can comprise two or more polymers selected from nylon, polyester, polypropylene, or other filament-forming polymer, and that the second longitudinally-extending component can comprise two or more halogenated polymers. In either case, the sum of the concentrations of polymers in the first longitudinally-extending component or in the second longitudinally-extending component preferably will be between about 80.0 wt % and 100.0 wt %. Additives as described above can also be added to either or both of the first longitudinally-extending component or the second longitudinally-extending component. The two or more polymers in the first longitudinally-extending component may be blended, or they may form separate layers, e.g. an outer layer surrounding an inner layer, the inner layer having a circular, pentalobal, or other cross-section; an outer layer consisting of longitudinal stripes over the inner layer; and other combinations of inner nd outer layers readily envisioned by one of skill in the art.

Preferably, the percentages by total filament weight of the first longitudinally-extending component and the second longitudinally-extending component can be from about 30%/70% (first/second component) to about 70%/30% (first/second component). First longitudinally-extending component percentages of less than about 30% will yield filaments with strength less than 2.0 g/den due to high levels of halogenated polymers; first longitudinally-extending component percentages of more than about 70% will yield filaments with first longitudinally-extending components insufficiently surrounded by second longitudinally-extending components to have a contact angle greater than or equal to 90 degrees. In order to reduce the materials expense associated with halogenated polymers, it is more preferable to have percentages by total filament weight of first longitudinally-extending component and second longitudinally-extending component components to be at least about 50%/50% (first/second component), and most preferably at least about 60%/40% (first/second component).

The denier (g/9000 m) per filament ("dpf") of the filament can be of any value known in textile filaments, typically in the range of from about 0.7 dpf to about 5.0 dpf.

In one embodiment of the invention, the filament comprises a core of 100 wt % polybutylene terephthalate (about 50% of filament by weight) and a sheath of 100 wt % melt-processible halogenated polymer (about 50% of filament by weight), in which the core has a circular cross-section and the sheath surrounds the core.

In another embodiment of the invention, the filament comprises a core of 100 wt % nylon 6,6 (about 50% of filament by weight) and a sheath of 100 wt % melt-processible halogenated polymer (about 50% of filament by weight), in which the core has a circular cross-section and the sheath surrounds the core.

In further embodiment of the invention, the filament comprises a core of about 95 wt % nylon 6,6 and about 5 wt % solution-pigmented melt-processible halogenated polymer (about 50% of filament by weight) and a sheath of 100 wt % melt-processible halogenated polymer (about 50% of filament by weight), in which the core has a circular cross-section and the sheath surrounds the core.

In yet another embodiment of the invention, the filament comprises a core of 100 wt % nylon 6,6 (about 50% of filament by weight) and a sheath of about 95 wt % unpigmented melt-processible halogenated polymer and about 5 wt % pigmented melt-processible halogenated polymer (50% of filament by weight), in which the core has a circular cross-section and the sheath surrounds the core.

In yet a further embodiment of the invention, the filament comprises a core of a copolymer of about 95 wt % nylon 6,6 and about 5 wt % nylon 6 (about 50% of filament by weight) and a sheath of 100 wt % melt-processible halogenated polymer (about 50% of filament by weight), in which the core has a circular cross-section and the sheath surrounds the core.

In a second class of embodiments of the invention, the present invention is directed to filaments comprising a first longitudinally-extending component comprising at least one filament-forming polymer as described above and a second longitudinally-extending component comprising an olefin copolymer. Preferably, the olefin copolymer is a random olefin copolymer comprising 4-methyl-1-pentene and 2–5 mol % of a C14 alkene comonomer (hereinafter the "random copolymer"). Such filaments have a contact angle greater than or equal to 90 degrees and a high tenacity. The contact angle greater than or equal to 90 degrees makes the filaments resistant to chemicals, and the high tenacity makes the filaments processible into a fabric. Hereinafter, "processible into a fabric" shall mean readily knitted or woven or both to form a fabric useful in textiles or packaging.

A filament of this embodiment has a contact angle and tenacity as described above. This provides for the filament to be both chemical-resistant and processible into a fabric. The first longitudinally-extending component and second longitudinally-extending component can be present in the "core/sheath" or "racing stripe" structure of the filament as described above.

The first longitudinally-extending component of the filament comprises at least one filament-forming polymer, such as nylon, polyester, and polypropylene. Preferably, the filament-forming polymer is nylon 6,6. Nylon 6,6 is known to have sufficiently high tenacity to be useful in the production of textile filaments. Nylon 6,6 used in the first longitudinally-extending component is heat stable in environments up to about 180° C. (360° F.) for up to 6 h, which allows it to retain tensile strength during curing. It is desirable for a filament-forming polymer to have crystallization rates and/or elongational viscosity similar to those same properties of the olefin copolymer of the second longitudinally-extending component in order to better share spinning stress.

The first longitudinally-extending component of the filament can also include additives as described above. Additional additives that can be used include the olefin copolymer, in order to aid adhesion to the olefin copolymer of the second longitudinally-extending component. The concentrations of the filament-forming polymer and any additives in the first longitudinally-extending component are as described above.

The second longitudinally-extending component of the filament comprises an olefin copolymer. Preferably, it comprises a melt-processible random olefin copolymer comprising 4-methyl-1-pentene and 2–5 mol % of a C14 alkene comonomer. The olefin copolymer provides a contact angle greater than or equal to 90 degrees to the filament. In addition, the olefin copolymer can be blended with other polyolefins. The components of the olefin copolymer are commercially available (e.g., from Airtech).

The second longitudinally-extending component can also include additives such as nucleating agents, colorants, and anti-microbial additives, among others. Nucleating agents, colorants, and anti-microbial additives are as described above. Other additives can be used, and their identity and the circumstances making their use desirable will be clear to one skilled in the art. It is desirable that any such additives not make the contact angle less than 90 degrees.

It is particularly desirable that the second longitudinally-extending component includes a polypropylene copolymer to improve the modulus. A preferred polypropylene copolymer is $CH_3—(CH_2—CH(CH_3))_n—(CH_2—CH_2)_x—CH_3$, wherein n and x can be any integer greater than zero. Preferred polypropylene copolymers are produced by Millennium Petrochemicals Inc. under the trade name FLEXATHENE TP4380HR, and by Airtech. In one embodiment, the second longitudinally-extending component comprises about 90 wt % olefin copolymer and about 10 wt % polypropylene copolymer.

The concentration of the olefin copolymer in the second longitudinally-extending component can be varied depending on the presence of other additives in the second longitudinally-extending component and the composition of the first longitudinally-extending component. Preferably, the concentration of the olefin copolymer in the second longitudinally-extending component can be from about 80.0 wt % to 100.0 wt %. The remaining 0.0 wt % to about 20.0 wt % can comprise nucleating agents, colorants, anti-microbial additives, the polypropylene copolymer, and other additives as described above.

It is to be noted that the first longitudinally-extending component can comprise two or more polymers selected from polyamide, polyester, polypropylene, or other filament-forming polymer. In this case, the sum of the concentrations of polymers in the first longitudinally-extending component preferably will be between about 80.0 wt % and 100.0 wt %. Additives as described above can also be added to the first longitudinally-extending component. The two or more polymers in the first longitudinally-extending component may be blended, or they may form separate layers, e.g. an outer layer surrounding an inner layer, the inner layer having a circular, pentalobal, or other cross-section; an outer layer consisting of longitudinal stripes over the inner layer; and other combinations of inner and outer layers readily envisioned by one of skill in the art.

Preferably, the percentages by total filament weight of the first longitudinally-extending component and the second longitudinally-extending component can be from about 30%/70% (first/second component) to about 70%/30% (first/second component). First longitudinally-extending component percentages of less than about 30% will yield filaments with strength less than 2.0 g/den due to high levels of the olefin copolymer; first longitudinally-extending component percentages of more than about 70% will yield filaments with first longitudinally-extending component insufficiently surrounded by second longitudinally-extending component to have contact angle greater than or equal to 90 degrees and chemical resistance. In order to reduce the materials expense associated with the olefin copolymer, it is more preferable to have percentages by total filament weight of the first longitudinally-extending component and the second longitudinally-extending component to be at least about 50%/50% (first/second component), and most preferably at least about 60%/40% (first/second component).

The denier (g/9000 m) per filament ("dpf") of the filament can be of any value known in textile filaments, typically in the range of from about 0.7 dpf to about 5.0 dpf.

In an embodiment of this class of the invention, the filament comprises a core of 100 wt % nylon 6,6 (50% of filament by weight) and a sheath of about 90 wt % olefin copolymer and 10% polypropylene copolymer, in which the core has a circular cross-section and the sheath surrounds the core.

In a further aspect, the present invention relates to yarns comprising a plurality of filaments, wherein each filament is as described above.

The present invention also relates to a method for melt spinning the yarns comprising a plurality of filaments, the method comprising coextruding (1) a first molten stock comprising at least one filament-forming polymer, and (2) a second molten stock comprising at least one polymer, whereby the second molten stock forms a second longitudinally-extending component located on the first molten stock, thereby forming molten filaments, and quenching the molten filaments, a plurality of which are formed into yarn. The method can further comprise drawing the yarn. Such yarns can be melt-spun using bicomponent melt-spin techniques known in the art.

To briefly summarize an exemplary method, the stock of polymers and additives to comprise the first longitudinally-extending component (the "first stock," "first polymer formulation," or "first polymer stream") and the stock of polymers and additives to comprise the second longitudinally-extending component (the "second stock," "second polymer formulation," or "second polymer stream") are in the molten state in separate extruders. The separate first and second polymer streams are then extruded into a spin pack, the spin pack comprising separate chambers for the first and second polymer streams, each chamber containing filter media; the spin pack also comprises one or more distribution plates and a spinneret. The distribution plates divide each of the first and second polymer streams into a number of smaller melt streams equal to the number of filaments to be spun. The distribution plates direct each of these smaller melt streams into the desired filament configuration above the spinneret. The combined melt streams are then each extruded through capillaries in the spinneret. The combined melt streams are then quenched or solidified in a chimney via cross-flow air, at which point they may be at or near the final spun-yarn denier. If needed in order to achieve the desired denier and physical properties, this spun yarn may be drawn (stretched) either during the spinning process or in a separate step thereafter. Finish may then be applied and the quenched melt streams taken up onto bobbins to form the spun yarn.

A typical yarn comprises from about 25 to about 100 filaments. Also, the yarn can further comprise a lubricating finish to aid in further processing. The finish can be any standard finish known in the art. A. typical, but non-limiting, finish is an emulsion of 10 wt % to 25 wt % modified vegetable oils in water, applied to a concentration of <0.2 wt % to 1.5 wt % oil per total yarn. It is to be noted that the finish is distinct from the second longitudinally-extending component, in that the second longitudinally-extending component is applied to the first longitudinally-extending component by coextrusion, whereas the finish is applied to the yarn after quenching of the coextruded bicomponent filaments to form the yarn.

It is desirable to manipulate the method of making the yarn in order to match the quenching and crystallization rates of the first and second polymer formulations. This will enhance the elongation and tenacity of the filaments, as is known to those skilled in the art. The quenching rates can be modified by varying the level of air flow through the chimney during the quenching step. Quenching and crystallization rates can be modified by altering the temperatures of the molten forms of each of the first and second polymer formulations prior to extrusion. The addition of nucleating agents and other additives may also effect quenching and crystallization rates. Altering the parameters of the spinning machine or the speed of spinning can effect quenching and crystallization rates as well. It is desirable to make the crystallization rates of the first longitudinally-extending component and the second longitudinally-extending component similar, and to make the overall quench rate not too high to produce breaks. The various ways of modifying the quenching and crystallization rates, and their results, will be clear to one skilled in the art in view of the goal of a yarn comprising filaments each with a tenacity of at least 2.0 g/d, and preferably at least about 3.0 g/d, and an elongation of 15%, and preferably at least 25%.

In one embodiment of the method for melt-spinning yarns of the present invention, the quench (air flow) rate is from 0 $m^3$/min to about 2.832 $m^3$/min (0 scfm (standard cubic feet per minute) to about 100 scfm), and preferably from about 0.708 $m^3$/min to about 1.416 $m^3$/min (about 25 scfm to about 50 scfm) for a yarn of 26–52 filaments, at a windup speed of 1000–3000 m/min (mpm), for a total polymer throughput of 1.8–2.8 kg/hr (4–6 pounds/hr) per threadline position and a final spun yarn denier of 150–350. This yarn is then drawn on a drawing stand using heated, powered rolls, at an appropriate draw ratio to give the final yam properties described above, at winder takeup speeds of 500–2000 mpm.

In a second embodiment of this aspect, the yarns comprise a plurality of filaments, wherein the filaments comprise a first longitudinally-extending component comprising at least one filament-forming polymer and a second longitudinally-extending component comprising the olefin copolymer. The yams can be melt-spun using substantially the same technique as described above, with the substitution of the olefin copolymer for the halogenated polymer.

The present invention is also directed to a fabric comprising a plurality of yarns as described above. In one embodiment, the filaments comprise a first longitudinally-extending component comprising at least one polymer selected from nylon, polyester, polypropylene, or other fiber-forming polymer and a second longitudinally-extending component comprising a halogenated polymer. In another embodiment, the filaments comprise a first longitudinally-extending component comprising at least one filament-forming polymer and a second longitudinally-extending component comprising the olefin copolymer. In either of the foregoing, in one embodiment, in the fabric the spacing between the yarns is sufficiently small to provide a barrier to liquids and sufficiently large to allow the passage of gases. This allows the fabric to resist moisture but still be breathable. In another embodiment, in the fabric the spacing between the yarns is sufficiently small to provide a barrier to both liquids and gases. This allows the fabric to function as an air-tight packaging material.

The present invention also relates to a method of making the fabric, comprising providing a plurality of yarns as described above, and weaving or knitting the plurality of yarns to provide a spacing between the yams sufficiently small to provide a barrier to liquids and sufficiently large to allow the passage of gases, to yield the fabric. Alternatively, the weaving or knitting step may be performed to provide a spacing between the yarns sufficiently small to provide a barrier to both liquids and gases, to yield the fabric.

The weaving or knitting pattern and the spacing between yarns to provide a barrier to liquids, or to provide a barrier to both liquids and gases will vary depending on the composition of the filaments, the number of filaments per yarn, the parameters of the melt-spinning of the yarn, and the desired density and thickness of the fabric. The appropriate pattern and spacing under a given set of conditions can be readily determined by one skilled in the art.

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLE 1

A halogenated sheath threadline was spun, comprising 60% core, 40% sheath by cross-sectional area (50%/50% by measured weight at pumpout). The core was 100% nylon 6,6, and the sheath was 100% HALAR®. The halogenated polymer temperature at the extruder discharge was controlled at 250° C., and the nylon polymer discharge temperature was controlled at 282° C. Threadlines of 26 filaments were generated at a total spun yarn denier of 200±30, 1000 mpm spinning speed, and with quench flow set at 50 fpm. The quenched yarn was treated with an aqueous oil emulsion spin finish of 12% oil concentration, giving 0.8% oil on yarn by weight. This yarn was in turn drawn on a separate draw-winding machine to a final denier of 90, giving 3.46 dpf for the 26 filament items. The draw ratio was therefore 2.22. Drawn items from these runs gave the following properties as measured using an Instron 5500 tabletop tensile property testing unit:

TABLE 1

| Property | Drawn Yarn Average | Spun Yarn Average |
|---|---|---|
| Breaking strength, g | 303.9 | 216.6 |
| Denier | 91.5 | 191.4 |
| Tenacity (g/den) | 3.33 | 1.13 |
| Elongation (%) | 24.4 | 110.0 |

Table 1 indicates that a drawn yarn comprising filaments comprising a core comprising at least one polymer selected from nylon, polyester, polypropylene, or other fiber-forming polymer, and a sheath comprising a halogenated polymer, has a tenacity greater than 3.0 g/den, and an elongation of at least 15%. Such a yarn is suitable for use in a fabric of the present invention.

EXAMPLE 2

A halogenated sheath threadline was spun according to Example 1, with the exception that the core was 95% nylon 6,6 and 5% nylon 6 on a molar basis of monomers. This yarn was in turn drawn on a separate draw-winding machine to a draw ratio of 3.00. Drawn items from these runs gave the following properties:

TABLE 2

| Property | Drawn Yarn Average | Spun Yarn Average |
|---|---|---|
| Breaking strength, g | 269.0 | 211.6 |
| Denier | 80.1 | 193.0 |
| Tenacity (g/den) | 3.35 | 1.12 |
| Elongation (%) | 18.1 | 125.4 |

Table 2 indicates that a drawn yarn comprising filaments comprising a core comprising at least one polymer selected from nylon, polyester, polypropylene, or other fiber-forming polymer, and a sheath comprising a halogenated polymer, has a tenacity greater than 3.0 g/den, and an elongation of at least 15%. Such a yarn is suitable for use in a fabric of the present invention.

EXAMPLE 3

The threadline of Example 2 was spun as described with the exception of being drawn to a draw ratio of 2.20. Drawn items from these runs gave the following properties, as tested as described in Example 2:

TABLE 3

| Property | Drawn Yarn Average | Spun Yarn Average |
|---|---|---|
| Breaking strength, g | 310.0 | 211.6 |
| Denier | 104.8 | 193.0 |
| Tenacity (g/den) | 2.97 | 1.12 |
| Elongation (%) | 21.4 | 125.4 |

Table 3 indicates that a drawn yarn comprising filaments comprising a core comprising at least one polymer selected from nylon, polyester, polypropylene, or other fiber-forming polymer, and a sheath comprising a halogenated polymer, has a tenacity greater than 2.0 g/den, and an elongation of at least 15%. Such a yarn is suitable for use in a fabric of the present invention.

EXAMPLE 4

A halogenated sheath threadline was spun as in Example 2, with the exception that the core was 95% nylon 6,6 and 5% HALAR®. Drawn items from these runs gave the following properties:

TABLE 4

| Property | Drawn Yarn Average | Spun Yarn Average |
|---|---|---|
| Breaking strength, g | 422.6 | 280.9 |
| Denier | 104 | 267.7 |
| Tenacity (g/den) | 4.1 | 1.05 |
| Elongation (%) | 15.7 | 155.3 |

Table 4 indicates that a drawn yarn comprising filaments comprising a core comprising at least one polymer selected from nylon, polyester, polypropylene, or other fiber-forming polymer, and a sheath comprising a halogenated polymer, has a tenacity greater than 3.0 g/den, and an elongation of at least 15%. Such a yarn is suitable for use in a fabric of the present invention.

EXAMPLE 5

A halogenated threadline was spun as described in Example 2, with the exception that the core consisted of 100% delustered nylon 6,6, wherein the nylon 6,6 was delustered with the addition of 2.5 wt % particulate pigment into the monomers either prior to polymerization or during the polymerization stage. Drawing was done to a draw ratio of 3.5, at draw-wind processing seeds of 1000 mpm. Drawn items from these runs gave the following properties:

TABLE 5

| Property | Drawn Yarn Average | Spun Yarn Average |
|---|---|---|
| Breaking strength, g | 248.6 | 172.4 |
| Denier | 85.1 | 266.4 |
| Tenacity (g/den) | 2.92 | 0.65 |
| Elongation (%) | 11.4 | 139.4 |

Table 5 indicates that a drawn yarn comprising filaments comprising a core comprising at least one polymer selected from nylon, polyester, polypropylene, or other fiber-forming, polymer, and a sheath comprising a halogenated polymer, has a tenacity greater than 2.0 g/den, and an elongation of at least 10%.

EXAMPLE 6

A halogenated polymer threadline was spun as described in Example 1, with the exceptions that the core was 100% PBT, 1.6 iv (Aristech), the sheath was 100% HALAR®, and the quench flow was 210 scfm. The spun yarn was drawn to a draw ratio of 2.01. Drawn items from these runs gave the following properties:

TABLE 6a

| Property | Drawn Yarn Average | Spun Yarn Average |
|---|---|---|
| Breaking strength, g | 360 | 268 |
| Denier-No. of filaments | 134-26 | 262-26 |
| Tenacity (g/den) | 2.7 | 1.1 |
| Elongation (%) | 22 | 108 |

Table 6a indicates that a drawn yarn comprising filaments comprising a core comprising at least one polymer selected from nylon, polyester, polypropylene, or other fiber-forming polymer, and a sheath comprising a halogenated polymer, has a tenacity greater than 2.0 g/den, and an elongation of at least 15%. Such a yarn is suitable for use in a fabric of the present invention.

The wetting data for the spun and drawn yarns, as well as for pure undrawn PBT and pure melt-processible halogenated polymer, were also determined. Dispersive surface energy was measured in methylene iodide, a purely dispersive liquid. Non-dispersive work of adhesion and contact angle were measured using water as the wetting liquid. The fibers were rinsed to remove spin finish before measurement. The method of measuring surface energetics of fibers is given by Tate et al., *J. Colloid and Interface Sci.,* 177, 579–588 (1996).

Dispersive energy is a measure of oleophobicity (resistance to wetting by oils), with lower values indicating more oleophobic character. Dispersive surface energy is equivalent to the critical surface energy often reported in the literature. Non-dispersive work of adhesion in water is a measure of the polar interactions of water with surfaces and is strongly related to water wetting behavior. Lower values of work of adhesion mean less wetting. The contact angle in water is also related to wetting behavior, with higher values of contact angle indicating less wetting. Contact angles greater than 90° are indicative of a hydrophobic surface.

The dispersive energy, non-dispersive work of adhesion, and contact angle for spun and drawn PBT/HALAR® yarns, undrawn pure PBT, and pure HALAR® are given in Table 6b.

TABLE 6b

| Fiber | Dispersive Surface Energy (mN/m) | Non-dispersive Work of Adhesion (mN/m) | Contact angle (°) |
|---|---|---|---|
| pure PBT (undrawn) | 27 | 29 | 85 |
| PBT/HALAR ® spun | 27 | 14 | 97 |
| PBT/HALAR ® drawn | 27 | 6.3 | 103 |
| pure HALAR ® | 27 | | |

As can be seen from the dispersive surface energies, HALAR® does not contribute additional oleophobic character over that of pure PBT. However, HALAR® significantly increases the hydrophobic nature of the fiber surfaces, as indicated in the lower values of non-dispersive work of adhesion and increased contact angle for the PBT/HALAR® fibers over pure PBT. Such yarns are suitable for use in the present invention.

EXAMPLE 7

A halogenated polymer threadline was spun as described in Example 6, with the exception that an electrically heated collar was placed in the quench chimney to retard the quench rate. The hot collar temperature was 240° C. The spun yarn was not drawn. The properties of the spun yarn were as follows:

TABLE 7

| Property | Spun Yarn Average |
|---|---|
| Breaking strength, g | 294 |
| Denier-No. of filaments | 275-36 |
| Tenacity (g/den) | 1.07 |
| Elongation (%) | 173 |

EXAMPLE 8

A bicomponent threadline was spun, comprising 60% core, 40% sheath by cross-sectional area (50%/50% by measured weight at pumpout). The core was 100% nylon 6,6, and the sheath was an olefin copolymer/polyolefin blend (90%:10% wt). Two threadlines of 13 filaments were generated at a total spun yarn denier of 85,958 mpm spinning speed, and with quench flow set at 120 cfm. The quenched yarn was treated with an aqueous oil emulsion spin finish of 10% oil concentration, giving 2.6% oil on yarn by weight. This yarn was in turn drawn on a separate draw-twisting machine to a final denier of 45, giving 3.46 dpf for the 13 filament items. The draw ratio was therefore 1.89. Drawn items from these runs gave the following properties as measured using an Instron 5500 tabletop tensile property testing unit:

TABLE 8a

| Property | Drawn Yarn Average | Spun Yarn Average |
|---|---|---|
| Breaking strength, g | 129.6 | 126.0 |
| Denier | 45.3 | 85.8 |

TABLE 8a-continued

| Property | Drawn Yarn Average | Spun Yarn Average |
|---|---|---|
| Tenacity (g/den) | 2.86 | 1.47 |
| Elongation (%) | 57.9 | 201.9 |

Table 8a indicates that a drawn yarn comprising filaments comprising a core comprising at least one polymer selected from nylon, polyester, polypropylene, or other fiber-forming polymer, and a sheath comprising an olefin copolymer/polyolefin blend, has a tenacity greater than 2.5 g/den, and an elongation of at least 15%. Such a yarn is suitable for use in a fabric of the present invention.

The wettability data for the nylon 6,6/olefin copolymer yarn and a pure nylon control were determined as described in Example 6. The results are as follows:

TABLE 8b

| Fiber | Dispersive Surface Energy (mN/m) | Non-dispersive Work of Adhesion (mN/m) | Contact angle (°) |
|---|---|---|---|
| nylon 6,6/olefin copolymer | 20 | 26 | 93 |
| pure nylon | 22 | 49 | 61 |

As can be seen from the dispersive surface energies, the olefin copolymer contributes negligible additional oleophobic character over that of pure nylon. However, the olefin copolymer significantly increases the hydrophobic nature of the fiber surfaces, as indicated in the lower values of non-dispersive work of adhesion ard increased contact angle for the nylon 6,6/olefin copolymer fibers over pure nylon. Such yarns are suitable for use in the present invention.

EXAMPLE 9

A bicomponent threadline was spun according to Example 8, with the exception of a 35% sheath, by cross-sectional area, of an olefin copolymer/polyolefin blend (90%:10% wt). This yarn was in turn drawn on a separate draw-winding machine to a draw ratio of 2.07. Drawn items from these runs gave the following properties:

TABLE 9

| Property | Drawn Yarn Average | Spun Yarn Average |
|---|---|---|
| Breaking strength, g | 229.0 | 219.1 |
| Denier | 73.0 | 143.1 |
| Tenacity (g/den) | 3.14 | 1.53 |
| Elongation (%) | 59.5 | 245.2 |

Table 9 indicates that a drawn yarn comprising filaments comprising a core comprising at least one polymer selected from nylon, polyester, polypropylene, or other fiber-forming polymer, and a sheath comprising an olefin copolymer/polyolefin blend, has a tenacity greater than 3.0 g/den, and an elongation of at least 15%. Such a yarn is suitable for use in a fabric of the present invention.

EXAMPLE 10

A bicomponent threadline was spun according to Example 9, with the exception of a 26% sheath, by cross-sectional area. This yarn was in turn drawn on a separate draw-winding machine to a draw ratio of 2.07. Drawn items from these runs gave the following properties:

TABLE 10

| Property | Drawn Yarn Average | Spun Yarn Average |
|---|---|---|
| Breaking strength, g | 193.3 | 222.0 |
| Denier | 87.3 | 181.6 |
| Tenacity (g/den) | 2.21 | 1.22 |
| Elongation (%) | 92.0 | 339.8 |

Table 10 indicates that a drawn yarn comprising filaments comprising a core comprising at least one polymer selected from nylon, polyester, polypropylene, or other fiber-forming polymer, and a sheath comprising an olefin copolymer/polyolefin blend, has a tenacity greater than 2.0 g/den, and an elongation of at least 15%. Such a yarn is suitable for use in a fabric of the present invention.

EXAMPLE 11

A bicomponent threadline was spun according to Example 10, and was in turn drawn on a separate draw-winding machine to a draw ratio of 2.07. Drawn items from these runs gave the following properties:

TABLE 11

| Property | Drawn Yarn Average | Spun Yarn Average |
|---|---|---|
| Breaking strength, g | 213.0 | 221.1 |
| Denier | 89.7 | 186.8 |
| Tenacity (g/den) | 2.37 | 1.18 |
| Elongation (%) | 115.1 | 356.5 |

Table 11 indicates that a drawn yarn comprising filaments comprising a core comprising at least one polymer selected from nylon, polyester, polypropylene, or other fiber-forming polymer, and a sheath comprising an olefin copolymer/polyolefin blend, has a tenacity greater than 2.0 g/den, and an elongation of at least 15%. Such a yarn is suitable for use in a fabric of the present invention.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the method described herein without departing from the concept, spirit and scope of the invention. More specifically, it will be apparent that certain agents which are chemically related may be substituted for the agents described herein while the same or similar results would be achieved. All such similar substitutes and modifications apparent to those skilled in the art are deemed to be within the spirit, scope and concept of the invention as defined by the appended claims.

What is claimed is:

1. A filament, comprising:

a first longitudinally extending component comprising about 95 wt % nylon 6,6 and about 5 wt % nylon 6; and, a second longitudinally extending component comprising at least one polymer;

wherein the second longitudinally extending component is present on the surface of the first longitudinally extending component, and wherein the filament has a contact angle greater than or equal to 90 degrees and a tenacity of at least 2.0 g/den.

2. The filament of claim 1, wherein the second longitudinally extending component comprises a halogenated polymer.

3. The filament of claim 2, wherein the concentration of the halogenated polymer in the second longitudinally extending component is from about 80 wt % to 100 wt %.

4. The filament of claim 2, wherein the halogenated polymer is poly(ethylene chlorotrifluoroethylene).

5. The filament of claim 1, wherein the second longitudinally extending component comprises an olefin copolymer.

6. The filament of claim 5, wherein the concentration of the olefin copolymer in the second longitudinally extending component is from about 80 wt % to 100 wt %.

7. The filament of claim 1, wherein the ratio of first longitudinally extending component to second longitudinally extending component is from about 50%/50% by weight to about 70%/30% by weight.

8. The filament of claim 1, wherein the denier of the filament is between about 0.7 dpf and about 5.0 dpf.

* * * * *